US007579787B2

(12) United States Patent
Chen et al.

(10) Patent No.: US 7,579,787 B2
(45) **Date of Patent: *Aug. 25, 2009**

(54) METHODS AND PROTECTION SCHEMES FOR DRIVING DISCHARGE LAMPS IN LARGE PANEL APPLICATIONS

(75) Inventors: Wei Chen, Campbell, CA (US); James C. Moyer, San Jose, CA (US); Paul Ueunten, San Jose, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/842,867

(22) Filed: Aug. 21, 2007

(65) Prior Publication Data

US 2007/0285033 A1 Dec. 13, 2007

Related U.S. Application Data

(63) Continuation of application No. 11/250,161, filed on Oct. 13, 2005, now Pat. No. 7,265,497.

(60) Provisional application No. 60/618,640, filed on Oct. 13, 2004.

(51) Int. Cl.
*G05F 1/00* (2006.01)
*H05B 41/16* (2006.01)

(52) U.S. Cl. ..... 315/291; 315/276

(58) Field of Classification Search ..... 315/291, 315/276, DIG. 2, 224–246, DIG. 4, DIG. 5, 315/254, 274

See application file for complete search history.

(56) References Cited

U.S. PATENT DOCUMENTS 4,855,888 A * 8/1989 Henze et al. ..... 363/17
5,528,192 A 6/1996 Agiman et al.
5,615,093 A 3/1997 Nalbant
5,619,402 A 4/1997 Liu
5,757,173 A 5/1998 Agiman
5,892,336 A 4/1999 Lin et al.
5,923,129 A 7/1999 Henry
5,930,121 A 7/1999 Henry
6,104,146 A 8/2000 Chou et al.
6,118,415 A 9/2000 Olson
6,198,234 B1 3/2001 Henry
6,198,245 B1 3/2001 Du et al.
6,259,615 B1 7/2001 Lin
6,307,765 B1 10/2001 Choi
6,396,722 B2 5/2002 Lin
6,459,602 B1 10/2002 Lipcsei
6,469,922 B2 10/2002 Choi
6,501,234 B2 12/2002 Lin et al.
6,507,173 B1 1/2003 Spiridon et al.
6,515,881 B2 2/2003 Chou et al.
6,531,831 B2 3/2003 Chou et al.
6,559,606 B1 5/2003 Chou et al.

(Continued)

*Primary Examiner*—Douglas W Owens
*Assistant Examiner*—Minh D A
(74) *Attorney, Agent, or Firm*—Perkins Coie LLP

(57) ABSTRACT

The present disclosure introduces a simple method and apparatus for converting DC power to AC power for driving discharge lamps such as a cold cathode fluorescent lamp (CCFL), an external electrode fluorescent lamp (EEFL), or a flat fluorescent lamp (FFL). Among other advantages, the invention allows the proper protection under short circuit conditions for applications where the normal lamp current is greater than safe current limit.

2 Claims, 4 Drawing Sheets

U.S. PATENT DOCUMENTS 6,570,344 B2 5/2003 Lin
6,654,268 B2 11/2003 Choi
6,657,274 B2 12/2003 Comeau et al.
6,707,264 B2 3/2004 Lin et al.
6,756,769 B2 6/2004 Bucur et al.
6,781,325 B2 8/2004 Lee et al.
6,804,129 B2 * 10/2004 Lin ..... 363/98
6,809,938 B2 10/2004 Lin et al.
6,853,047 B1 2/2005 Comeau et al.
6,856,519 B2 2/2005 Lin et al.
6,864,669 B1 3/2005 Bucur
6,870,330 B2 * 3/2005 Choi ..... 315/307
6,873,322 B2 3/2005 Hartular
6,876,157 B2 4/2005 Henry
6,888,338 B1 5/2005 Popescu-Stanesti et al.
6,897,698 B1 5/2005 Gheorghiu et al.
6,900,993 B2 5/2005 Lin et al.
6,906,497 B2 6/2005 Bucur et al.
6,936,975 B2 8/2005 Lin et al.
6,946,806 B1 9/2005 Choi
6,979,959 B2 12/2005 Henry
6,999,328 B2 2/2006 Lin
7,023,709 B2 4/2006 Lipcsei et al.
7,057,611 B2 6/2006 Lin et al.
7,061,183 B1 6/2006 Ball
7,075,245 B2 7/2006 Liu
7,095,392 B2 8/2006 Lin
7,112,929 B2 9/2006 Chiou
7,112,943 B2 9/2006 Bucur et al.
7,120,035 B2 10/2006 Lin et al.
7,126,289 B2 10/2006 Lin et al.
7,141,933 B2 11/2006 Ball
7,157,886 B2 1/2007 Agarwal et al.
7,161,309 B2 1/2007 Chiou et al.
7,173,382 B2 2/2007 Ball
7,183,724 B2 2/2007 Ball
7,183,727 B2 2/2007 Ferguson et al.
7,187,139 B2 3/2007 Jin
7,187,140 B2 3/2007 Ball
7,190,123 B2 3/2007 Lee
7,200,017 B2 4/2007 Lin
7,265,497 B2 * 9/2007 Chen et al. ..... 315/209 R
2002/0180380 A1 12/2002 Lin
2005/0030776 A1 2/2005 Lin
2005/0093471 A1 5/2005 Jin
2005/0093482 A1 5/2005 Ball
2005/0093484 A1 5/2005 Ball
2005/0151716 A1 7/2005 Lin
2005/0174818 A1 8/2005 Lin et al.
2005/0225261 A1 10/2005 Jin
2006/0202635 A1 9/2006 Liu
2006/0232222 A1 10/2006 Liu et al.
2006/0279521 A1 12/2006 Lin
2007/0001627 A1 1/2007 Lin et al.
2007/0046217 A1 3/2007 Liu
2007/0047276 A1 3/2007 Lin et al.
2007/0085493 A1 4/2007 Kuo et al.

* cited by examiner

METHODS AND PROTECTION SCHEMES FOR DRIVING DISCHARGE LAMPS IN LARGE PANEL APPLICATIONS

PRIORITY CLAIM

The present invention is a Continuation of U.S. patent application Ser. No. 11/250,161, filed Oct. 13, 2005, which claims priority to U.S. Provisional Patent Application Ser. No. 60/618,640 filed Oct. 13, 2004.

TECHNICAL FIELD

The present invention relates to the driving of fluorescent lamps, and more particularly, to methods and protection schemes for driving cold cathode fluorescent lamps (CCFL), external electrode fluorescent lamps (EEFL), and flat fluorescent lamps (FFL).

BACKGROUND

In large panel displays (e.g., LCD televisions), many lamps are used in parallel to provide the bright backlight required for a high quality picture. The total current at full brightness can easily exceed the current limitations determined by governmental regulations. For example, the current limit as stated in Underwriters Laboratory (UL) standard UL60950 must not exceed 70 mA when the power inverter is shorted by a 2000 ohm impedance. However, the secondary side current in a typical 20-lamp backlight system may exceed that amount of current.

Traditional protection schemes measure the lamp currents, transformer primary current, or transformer current in general. Then, these currents are limited to below the maximum safe currents. However, this approach still has drawbacks.

DETAILED DESCRIPTION

The present invention relates to an apparatus and method for driving discharge lamps in large panel applications with overcurrent protection. The present invention can offer, among other advantages, a nearly symmetrical voltage waveform to drive discharge lamps, accurate control of lamp current to ensure good reliability, and protection schemes that limit circuit current under short circuit conditions.

Figure 1:
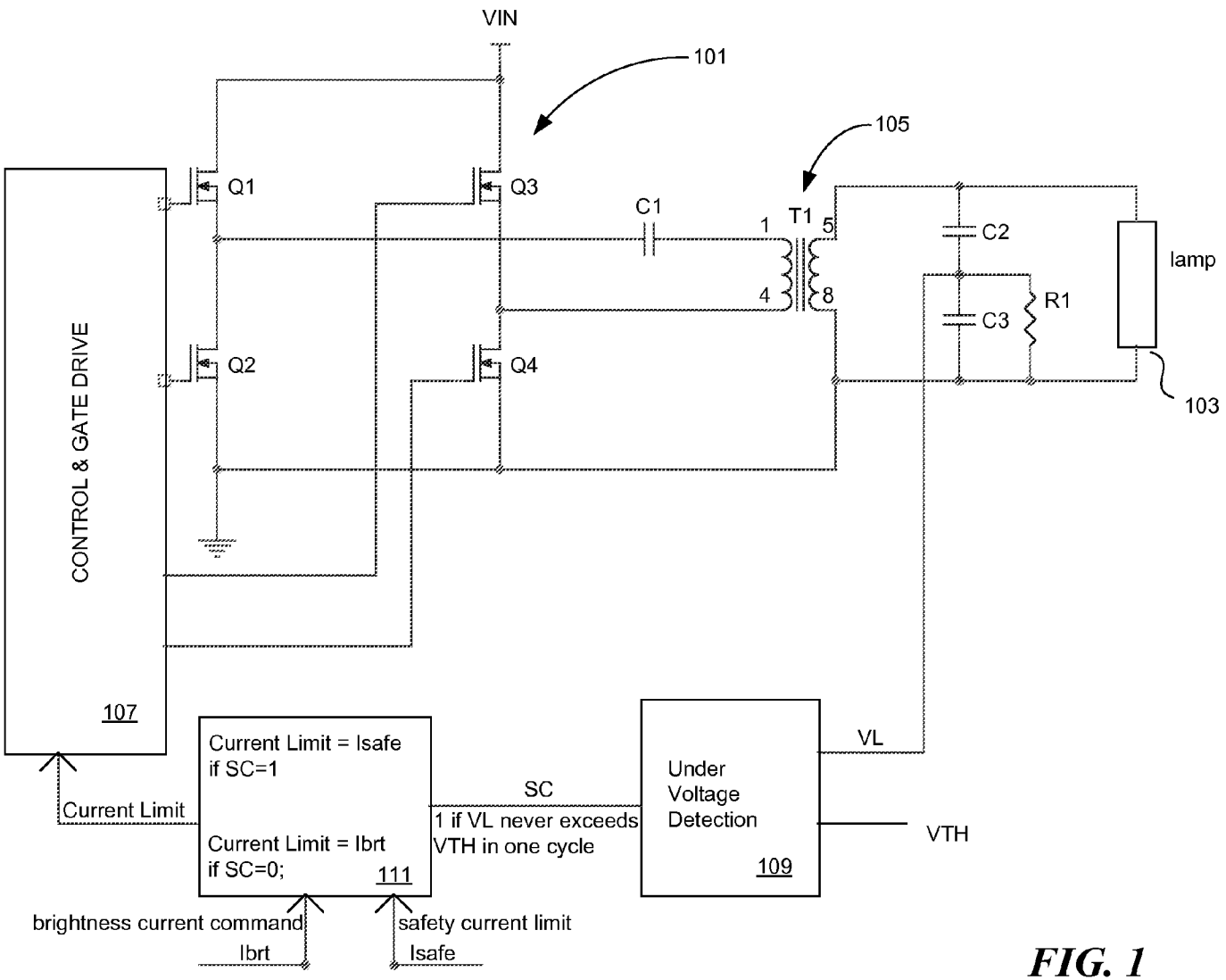
FIG. 1 is a schematic diagram showing a first embodiment of the present invention.

FIG. 1 shows a simplified schematic diagram of one embodiment of the present invention. In general, EEFL and FFL devices have higher impedance than CCFL devices because they use external electrodes. The intrinsic capacitance greatly increases the series impedance. The impedance of a lamp is typically between 120 Kohm and 800 Kohm. Even with 30 lamps in parallel, the total impedance is still greater than 4 Kohm. As specified in UL60950, the impedance at short circuit is tested at 2 Kohm. Therefore, the present invention uses impedance as one way to differentiate the short circuit conditions from the normal operating conditions. There are several embodiments of the present invention described below.

Turning to FIG. 1, a full-bridge inverter circuit 101 is used to drive a lamp load 103 through a transformer 105. The lamp load 103 is shown as a single element, but is intended in some embodiments to represent multiple CCFLs, EEFLs, and/or FFLs. FIG. 1 also shows a control and gate driver circuit 107 which performs two main functions: (1) provide the appropriate control signals to the transistors of the full-bridge inverter 101 and (2) receive feedback to monitor various parameters.

The circuit of FIG. 1 monitors the AC amplitude of the transformer secondary side voltage as one of the parameters used in order to determine whether or not to initiate a protection protocol. The capacitors C1, C2, C3, the leakage inductance of transformer, and the magnetizing inductance of transformer (if it is small enough) forms a filter circuit that converts the square wave voltage generated by the full bridge inverter switches (Q1-Q4) into a substantially sinusoidal waveform input to the lamp load 103.

As noted above, the control and gate drive 107 generates the gate drive waveforms with appropriate duty cycle to regulate the lamp current to its reference current limit. The control section 107 also receives feedback on the lamp current (the current on the secondary side of the transformer 105). Capacitors C2 and C3 are also used as a voltage divider when sensing the transformer or lamp voltage. Resistor R1 is typically a very large resistor forcing a zero DC bias on a voltage feedback node.

Note that if the peak of the transformer voltage (the AC sine wave) on the secondary side (or load side) on node VL does not exceed a preset threshold $V_{TH}$ (for example, 40% of the normal operating voltage on node VL), this indicates a possible short circuit condition. A safety current threshold $I_{SAFE}$ is used as a current limit when there is a possible short circuit condition. The preset threshold $V_{TH}$ may also, for example, be set between 25 to 55 percent of the normal operating voltage.

In one embodiment, $I_{SAFE}$ is the RMS value $I_{RMS}$ of the normal operating current or the average rectified value $I_{RECT,AVG}$ ($I_{RECT,AVG}=I_{RMS}*2*\text{sqrt}(2)/\pi$). Thus, an under-voltage detection block (such as a comparator) 109, which can be implemented using a myriad of circuits, is used to compare the voltage on node VL to $V_{TH}$. If VL is less than $V_{TH}$ for at least one switching cycle, the under-voltage detection block 109 will indicate the short circuit condition to a current limit selection block 111 and then choose the safety current $I_{SAFE}$ as the current limit. Otherwise, the under voltage detection block 109 will indicate to the current limit selection block 111 to choose the "normal" current limit, which in one embodiment is determined by an external brightness command level, $I_{BRT}$. However, it should be appreciated that the normal current limit in some embodiments is not limited to $I_{BRT}$, and instead may be set by other controllable parameters.

Note that if the negative AC amplitude of the transformer voltage never decreases below the preset threshold $V_{TH}$ (for example, 40% of the normal operating voltage), the short circuit protection current, preferably, RMS value $I_{RMS}$ or the average rectified value $I_{RECT,AVG}$, is smaller than the safety current $I_{SAFE}$.

Figure 2:
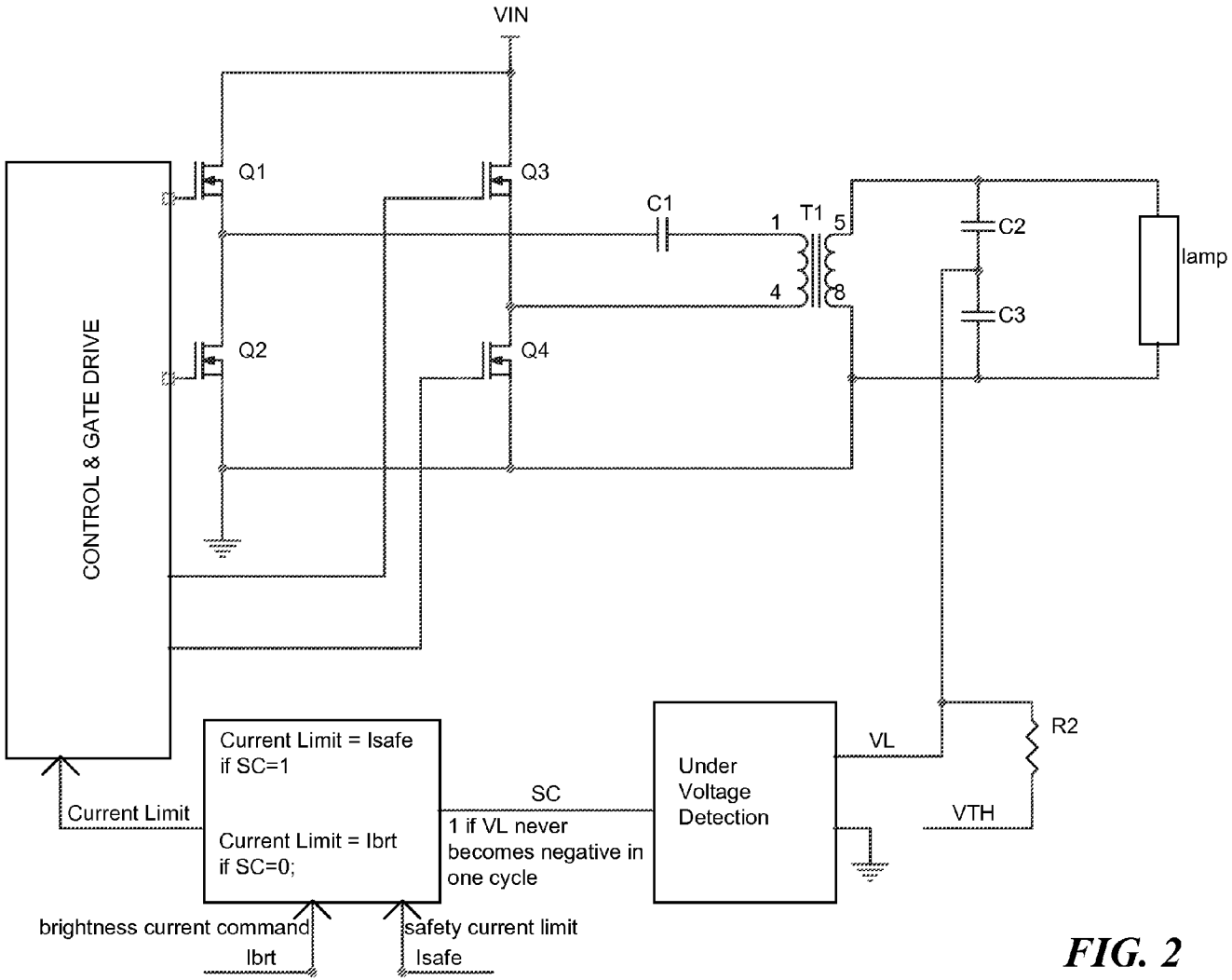
FIG. 2 is a schematic diagram showing a second embodiment of the present invention.

A variant implementation of FIG. 1 is shown in FIG. 2. In FIG. 2, resistor R2 biases VL to $V_{TH}$. Thus, if the input voltage to the under voltage detector 109 never drops below zero volts for at least one switching cycle, the AC amplitude of VL will be smaller than $V_{TH}$, indicating a short circuit condition.

In UL60950, the standard short circuit impedance of 2 kohm is much smaller than the lamp impedance for a CCFL, EEFL, or FFL. Therefore, the secondary or lamp current in a lamp application will be smaller than the current flowing through a 2 kohm load for the UL60950 test.

Figure 3:
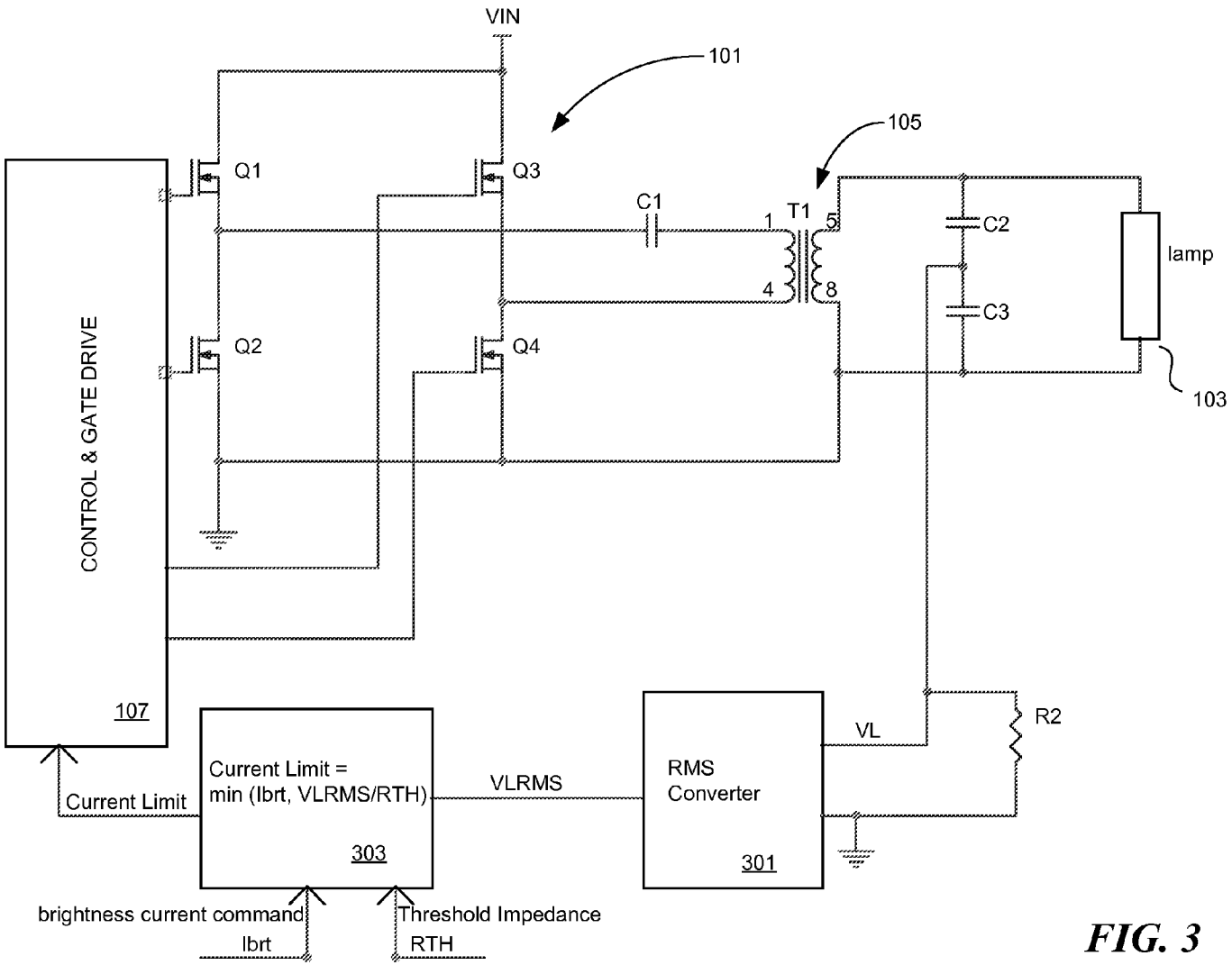
FIG. 3 is a schematic diagram showing a third embodiment of the present invention.
Figure 4:
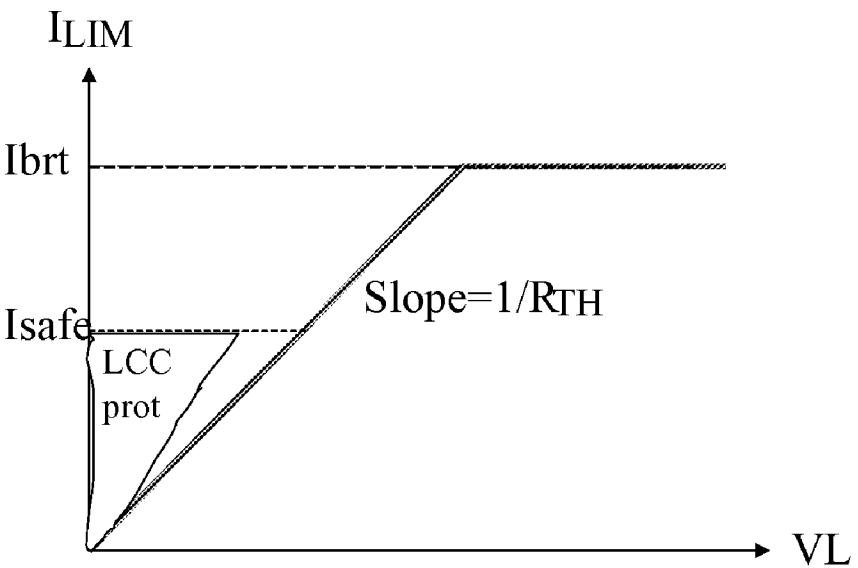
FIG. 4 is a graph showing current versus the voltage on the feedback node in accordance with the present invention.

FIG. 3 shows another implementation of the present invention. In this embodiment, $R_{TH}$ is set where $R_{TH}/(1+C3/C2)$ is between 2 kohm and the minimum lamp impedance. By choosing $R_{TH}/(1+C3/C2)$ higher than 2 kohm, it can be guaranteed that the short circuit current is lower than the safety current, as shown below. As seen in FIG. 3, a RMS converter 301 converts the feedback lamp voltage VL into a RMS value first and outputs a signal denoted VLRMS. Similar to FIG. 2, R2 is used to eliminate the dc bias in the feedback voltage VL. Note that the value of R2 is chosen to be significantly higher than the lamp impedance. Next, the short circuit analyzer 303 is used to output a current limit that is the minimum of $VL/R_{TH}$ and $I_{BRT}$. The resulting current limit is shown in FIG. 4. The heavy line is for normal operation current. The shaded area shows the LCC (Limited Circuit Current) protection region where VL may be smaller than $I_{SAFE}*R_{TH}$.

As long as $(1+C3/C2)*V_{TH}/I_{RMS}>=1.4*2$ Kohm, the circuit will guarantee that the short circuit current is always smaller than the safety current and the inverter operates properly with large lamp current which is greater than the safety current.

Note also that the short circuit current can be measured by a single resistor or capacitor in a fixed frequency inverter, and by the parallel combination of the resistor and capacitor in a variable frequency inverter.

The examples shown previously sense the voltage on the secondary side with a grounded sense. In other embodiments, the voltage and/or current may be sensed on the primary side. Still alternative, a differential sense scheme for floating drive inverters may be used. Furthermore, the teachings of the present invention may be used with other inverter topologies, including push-pull, half-bridge, etc.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A method of short circuit protection at a lamp load in a driver apparatus, the driver apparatus driving the lamp load through a transformer, the method comprising:

monitoring a feedback voltage on a load side of said transformer; comparing a brightness current limit with a safety current; and limiting a current supplied by said driver apparatus to a minimum of a brightness current and a safety current, wherein said safety current is the root mean square of said feedback voltage divided by a threshold impedance $R_{TH}$.

2. The method of claim 1 wherein said feedback voltage is monitored from a node between two series capacitors connected in parallel to said load and a secondary of said transformer.

* * * * *